US005931587A

United States Patent [19]

Hayama

[11] Patent Number: 5,931,587

[45] **Date of Patent: *Aug. 3, 1999**

[54] TAPE PRINTING APPARATUS WITH BLANK SETTING FUNCTION

[75] Inventor: Hitoshi Hayama, Suwa, Japan

[73] Assignees: Seiko Epson Corporation; King Jim Co., Ltd., both of Tokyo, Japan

[ * ] Notice: This patent is subject to a terminal disclaimer.

[21] Appl. No.: 09/107,907

[22] Filed: Jun. 22, 1998

Related U.S. Application Data

[63] Continuation of application No. 08/623,577, Mar. 28, 1996, Pat. No. 5,800,074.

[30] Foreign Application Priority Data

Mar. 31, 1995 [JP] Japan ..... 7-100496
Mar. 18, 1996 [JP] Japan ..... 8-61491

[51] Int. Cl.[6] ..... B41J 11/36

[52] U.S. Cl. ..... 400/76; 400/615.2

[58] Field of Search ..... 400/615.2, 586, 400/61, 64, 70, 76

[56] References Cited

U.S. PATENT DOCUMENTS 3,650,059 3/1972 Johnson ..... 400/134.4
5,222,818 6/1993 Akiyama et al. .
5,374,130 12/1994 Hirono .
5,403,101 4/1995 Nagase et al. .
5,409,317 4/1995 Ueno et al. .

FOREIGN PATENT DOCUMENTS 6247431 9/1994 Japan .

*Primary Examiner*—John Hilten
*Attorney, Agent, or Firm*—Loeb & Loeb LLP

[57] ABSTRACT

A tape printing apparatus with a blank setting function is provided which enables a blank of a desired length to be formed at a desired position when input text data is printed. Thus, an improvement is achieved in the degree of freedom available for controlling printing layout. The tape printing apparatus includes a printing device for printing input text data on a tape recording medium being fed, a blank position setting device for designating the position of a blank to be made when printing is performed by the printing device, a blank length designating device for designating the length of the blank, and a control device for controlling the printing device such that the text data is printed while making a blank with the length as designated by the blank length designating device at a position corresponding to the blank position designated by the blank position designating device.

18 Claims, 14 Drawing Sheets

TAPE PRINTING APPARATUS WITH BLANK SETTING FUNCTION

CROSS REFERENCE TO RELATED APPLICATION

This is a continuation application of Ser. No. 08/623,577 filed Mar. 28, 1996, now U.S. Pat. No. 5,800,074.

BACKGROUND OF THE INVENTION

Technical Field

The present invention relates to a tape printing apparatus for printing input text data on a tape recording medium, the printed portion of which is cut off to provide a printed label or the like. More specifically, the present invention relates to a tape printing apparatus with a blank setting function which is capable of printing while making blanks.

Discussion

Previously, a small tape printing apparatus, generally referred to as a label printer or a label word processor, is used to print on a tape printing medium and then cut the recording medium to a predetermined length after printing. The unprinted side of the tape recording medium is generally formed as an adhesive surface so that the cut portion of the printing medium can be secured to a desired location to serve as a label.

Unlike word processors or typewriters, the above-described tape printing apparatus perform printing with a printing head situated at a fixed position while the tape, which is formed as a long narrow strip, is fed in a fixed direction. Thus, line adjustment functions of the input data, such as front justification and centering, are not available as in word processors or the like. Furthermore, since the printed portion of the tape is cut to facilitate use, it is necessary for the apparatus to provide an appropriate blank at the head and rear of each printed piece of tape.

This necessity is taken into account in, for example, the tape printing apparatus as disclosed in Japanese Patent Laid-Open No. 5-185663. This apparatus controls line adjustments of the input text data such as right-hand justification, left-hand justification, centering and edge justification, based on the length of the line having the maximum length.

However, this type of conventional tape printing apparatus only allows line adjustments, such as right-hand justification and centering, to be effected according to a pre-set standard. Thus, it is impossible to make a blank of a desired length at a desired position of the input text data to be printed. Therefore, only a very narrow degree of freedom is available regarding the printing layout.

Also, Japanese, Patent Laid-Open No. 4-122660 discloses a tape printing apparatus providing blanks to be formed of previously determine lengths at the head and the rear of each printed piece of tape. Therefore, a blank can be formed with a desired length at either end of the piece.

In this type of conventional tape printing apparatus it is possible to provide margins at the front and rear ends of each printed piece of tape. However, the lengths of the margins have to be pre-set for each printing which is burdomsome and inconvenient.

SUMMARY OF THE INVENTION

The above and other objects are provided by a tape printing apparatus including a blank setting function enabling a blank of a desired length to be easily formed at a desired position while printing input text data. Thus, the degree of freedom available with respect to the printing layout is greatly enhanced.

The present invention provides a tape printing apparatus with a blank setting function. The apparatus comprises printing means for printing input text data on a fed tape recording medium, blank position setting means for designating the position of the blank to bet formed while printing is performed by the printing means, blank length designating means for designating the length of the blank, and control means for controlling the printing means. In this way, the text data is printed while making a blank having the length as designated by the blank length designating means at a predetermined position as designated by the blank position designating means.

According to the invention, the position of the blank is designated by the blank position designating means and the length of the blank is designated by the blank length designating means. Thus, the control means controls the printing means such that it prints the text data while making a blank having a length designated by the blank length designating means at a predetermined position corresponding to the position designated by the blank position designating means. Accordingly, a blank with a desired length can be easily made at a desired position of the text data thereby improving the degree of freedom available with respect to printing layout.

It is desirable for the apparatus to further comprise blank type setting means for designating the type of blank to be formed as either per line or per paragraph. In this construction, the type of blank can be designated as either lines or paragraphs of the text data. For example, when the type of blank is designated as lines, a blank is made exclusively in a particular line. Thus, the printing of that line is effected at a position that is retracted as compared with the other lines. When the type of blank is designated as paragraphs, a blank is made in every line of the text. Thus, it is possible to print a blank in a plurality of lines. In this way, further improvement is achieved in terms of printing layout.

It is also desirable for the blank length designating means to be capable of designating the length of a blank based on a plurality of length units. In this embodiment, the length of a blank can be designated on the basis of a length unit selected from characters, millimeters, printing dots or others. Therefore, the length of the blank can be finely set as desired.

It is further desirable for the apparatus to comprise storage means for storing text data, blank character setting means for setting blank characters and blank character inserting means for inserting the blank characters at a designated position of the text data stored in the storage means. In this embodiment, when the length of a blank is designated by the blank length designating means, the blank character setting means automatically sets blank characters having blank information including the designated length. These blank characters are automatically inserted at a designated position of the text data in the storage means by the blank character inserting means. The control means may then control the printing means based on the text data in the storage means and the blank characters. In this way, a blank with a desired length can be easily made at a designated position in printing.

Furthermore, the above objects can be achieved in accordance with the present invention by a tape printing apparatus having a blank setting function comprising printing means for printing input text data on a fed tape recording medium, margin setting/designating means for designating margins when printing is performed and control means for controlling the printing means. Accordingly, printing may be performed while providing a margin of a predetermined length at the front and/or rear end of the text data In this embodiment, when a margin is designated by the margin setting/designating means, the printing means prints the text data while providing a margin of a predetermined length at the front and/or rear end of the text data. In this way, a margin with a predetermined length is automatically provided solely by designating the provision of a margin therefore eliminating the need to set the length of the margin.

It is desirable for the control means to determine the preset length of the margin through a calculation based on the total length of the text data. In this embodiment, the control means determines the length of the margin based on the total length of the text data. Therefore, it is possible for the margin length to be appropriately set according to the length of the text.

DETAILED DESCRIPTION OF THE PREFERRED EMBODIMENTS INVENTION

Figure 1:
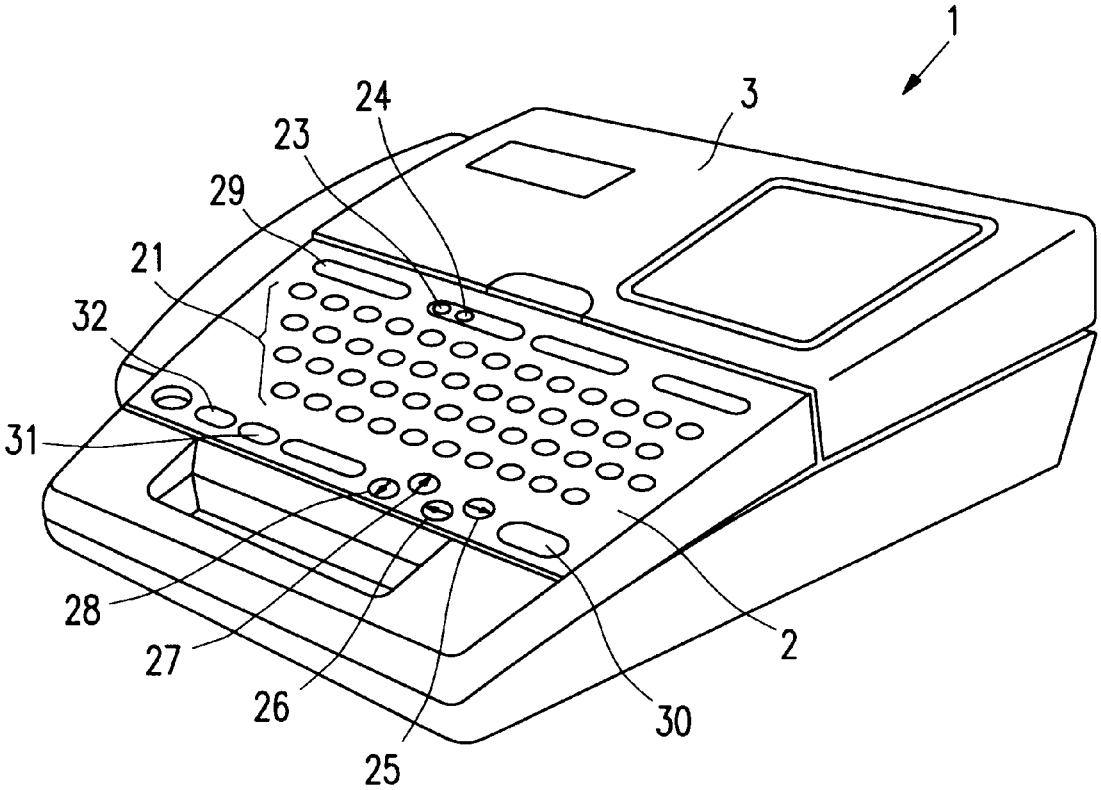
FIG. 1 is a perspective view of a tape printing apparatus having a blank setting function according to the present invention.
Figure 2:
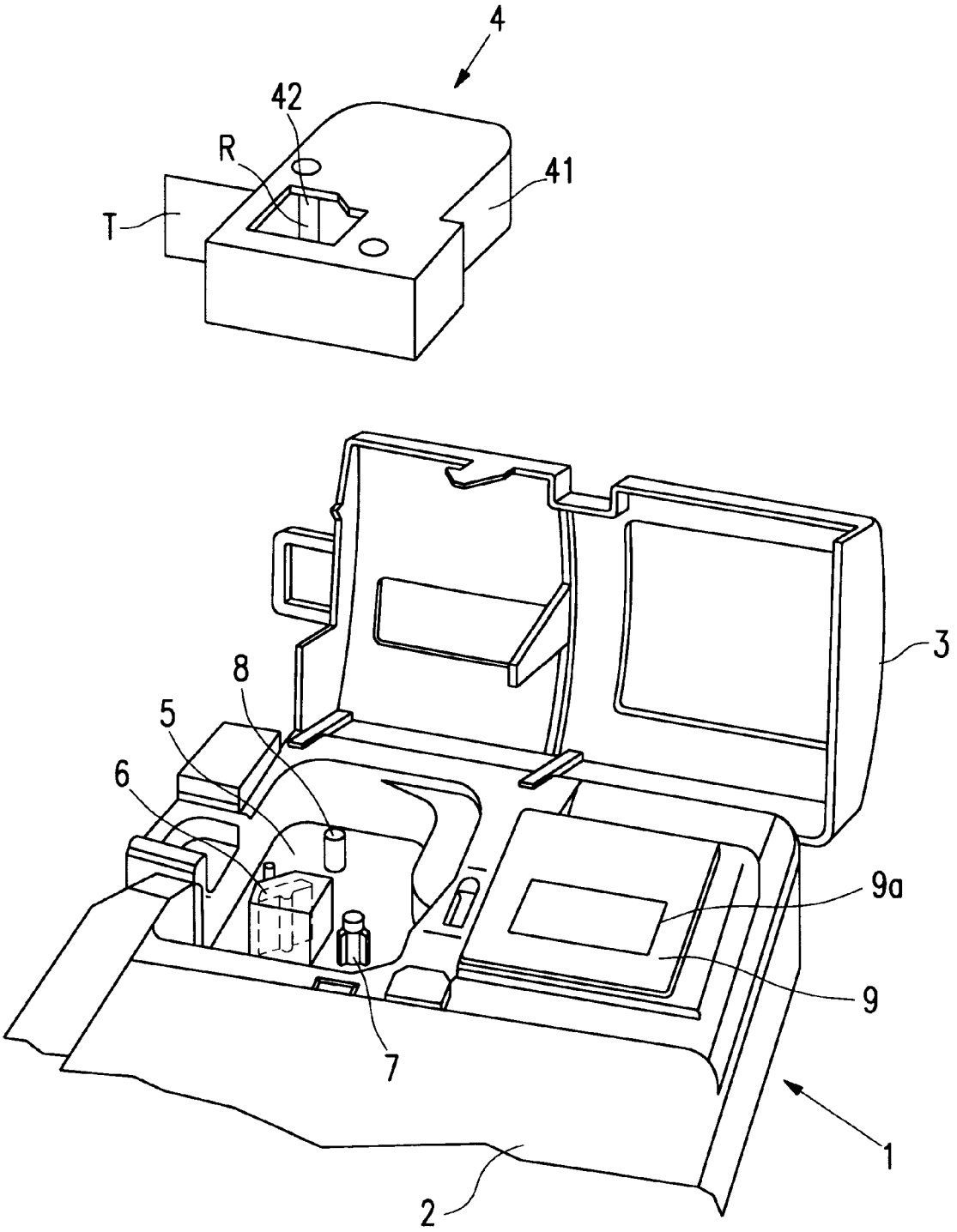
FIG. 2 is a partially exploded view of the tape printing apparatus of FIG. 1 with its cover in an open position.

An embodiment of the present invention will now be described in detail with reference to the drawings in which FIGS. 1 and 2 show the overall construction of a tape printing apparatus according to the present invention. As shown in the drawings, the tape printing apparatus, generally indicated by numeral 1, has a keyboard 2 in the front upper section thereof and a cover 3 in the rear section thereof. On the keyboard 2 are arranged a group of character keys 21 including alphabet and symbol keys, a group of function keys for designating various operation modes, and other keys generally known in the art. The group of function keys include four cursor moving keys 25, 26, 27 and 28, a printing key 29 for starting printing operation, a selection key 30 for setting various modes, a blank setting key 31 for designating the blank character input mode and a special blank setting key 32 for setting and inputting special blank characters. The functions of the blank and special blank characters will be described in detail below.

As shown in FIG. 2, under the cover 3 is an attachment section 5 to which a tape cartridge 4 can be attached and a liquid crystal display 9. The tape cartridge 4 contains a tape recording medium (a tape) T having a fixed width. One side of the tape T includes an adhesive surface covered with a detachable sheet of, for example, paper. The tape cartridge 4 also contains an ink ribbon R. The tape T and the ink ribbon R are fed in a manner such that they are in contact with each other as they pass under a window 42 formed in the case 41 of the cartridge 4. However, only the tape T is fed to the exterior. The ink ribbon R remains inside the tape cartridge 4.

In the attachment section 5 is arranged a thermal head 6 (printing means) which is brought into contact with a portion of the ink ribbon R exposed through the window 42 of the tape cartridge 4 when attached to the attachment section 5. By causing the thermal head 6 to generate heat, a print image in the form of a desired character, symbol, design or the like is printed on the surface of the tape T. Also provided in the attachment section 5 are driving shafts 7 and 8 which engage the driven section of the tape cartridge 4. The driving shafts 7 and 8 cause the tape T and the ink ribbon R to be fed within the tape cartridge 4.

The liquid crystal display 9 includes a display screen 9*a* large enough to display two lines of input characters. The portion of the cover 3 facing the liquid display screen is preferably a transparent window enabling the display screen 9*a* to be viewable when the cover 3 is in a closed position.

Figure 3:
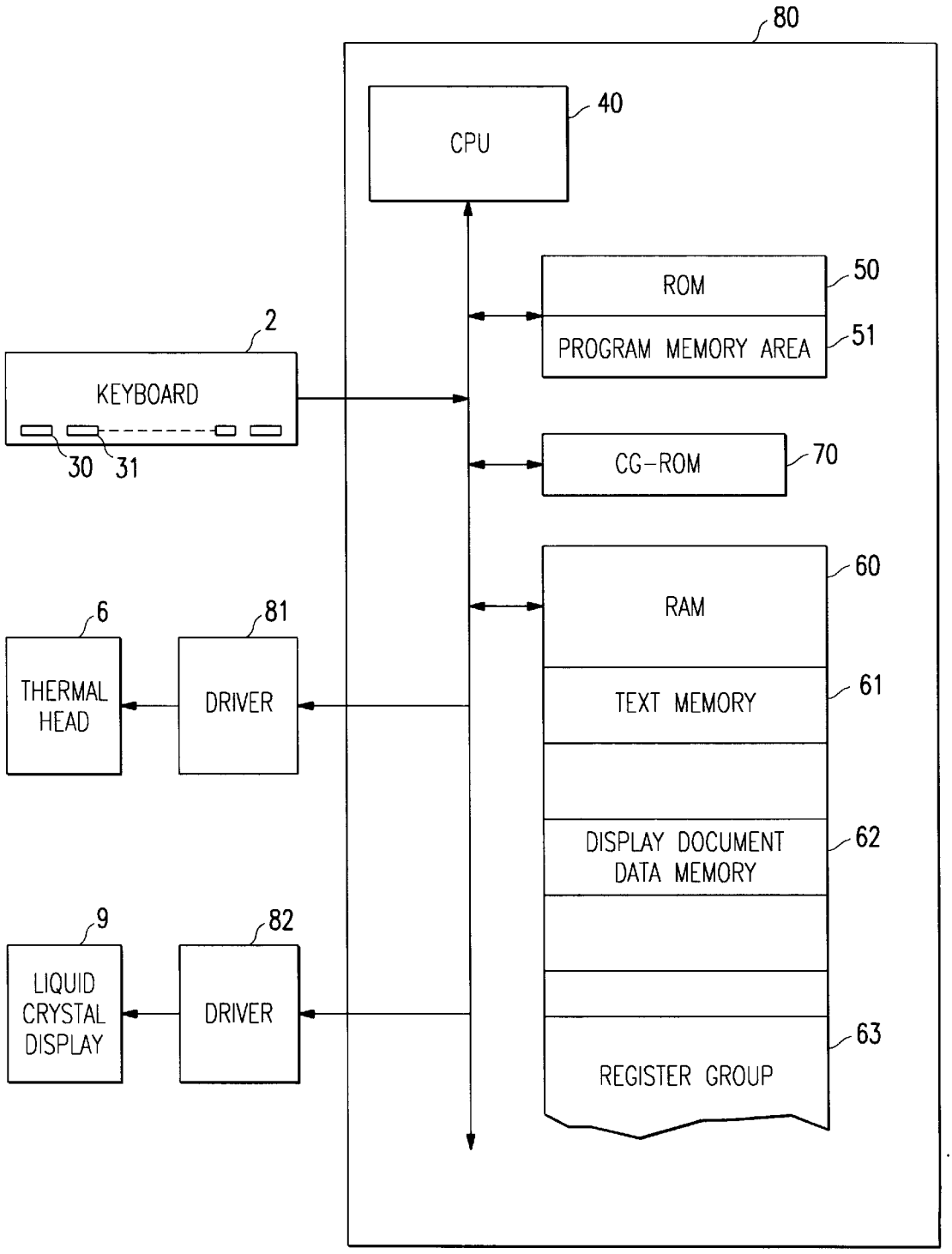
FIG. 3 is a schematic block diagram of the control system of the tape printing apparatus of FIG. 1.

The construction of the control system of the tape printing apparatus 1 will now be described with reference to FIG. 3. The control system has a control circuit 80, including a CPU 40, a ROM 50, a RAM 60 and a character generator ROM (hereinafter referred to as "CG-ROM") 70. The keyboard 2 is connected to the input port side of the control circuit 80 and the thermal head 6 is connected to the output port side of the control circuit 80 through the intermediation of a head driving driver 81. Also, the liquid crystal display 9 is connected to the output side of the control circuit through the intermediation of a driver 82 for display drive.

The ROM 50 includes a program memory area 51 which stores, for example, a control program for controlling the thermal head 6 and the liquid crystal display 9 and a control program for blank setting. The control program for blank setting is executed upon depressing the blank setting key 31.

The RAM 60 (storage means) includes a text memory 61 for temporarily storing text data corresponding to the input text, a display text data memory 62 for storing the text data displayed on the display 9 and a group of registers 63 for storing the calculation results of the CPU 40. Of course RAM 60 could also be configured to store additional information as desired. The CG-ROM 70 stores the dot patterns of the characters, symbols, and other forms to be printed. When coded data specifying a character or the like is input, GG-ROM 70 outputs a corresponding dot pattern.

Next, a blank input operation executed in the tape printing apparatus 1 will be described. The blank input operation described hereunder permits setting and inputting a blank with a desired length at a desired position in the text data input through the keyboard 2.

Figure 4:
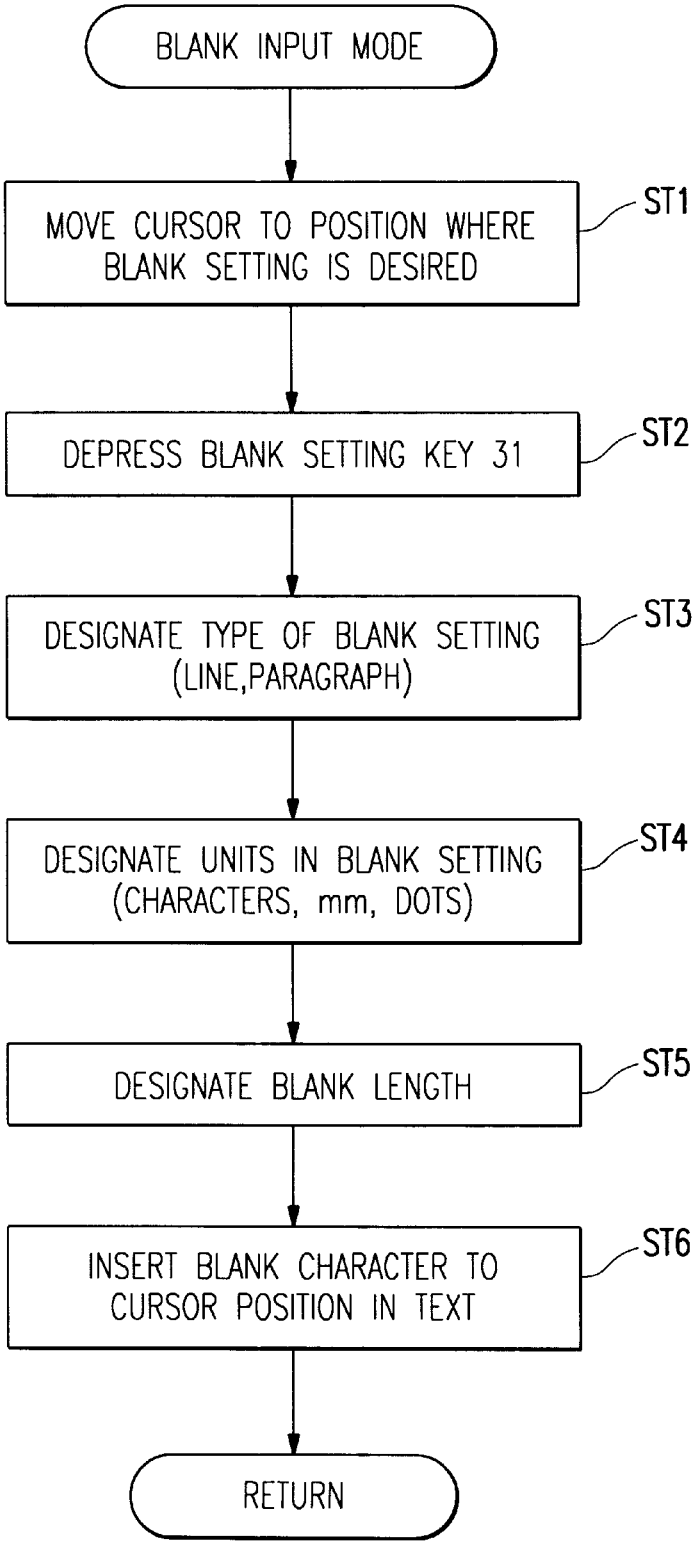
FIG. 4 is a schematic flowchart illustrating a blank setting operation.
Figure 5:
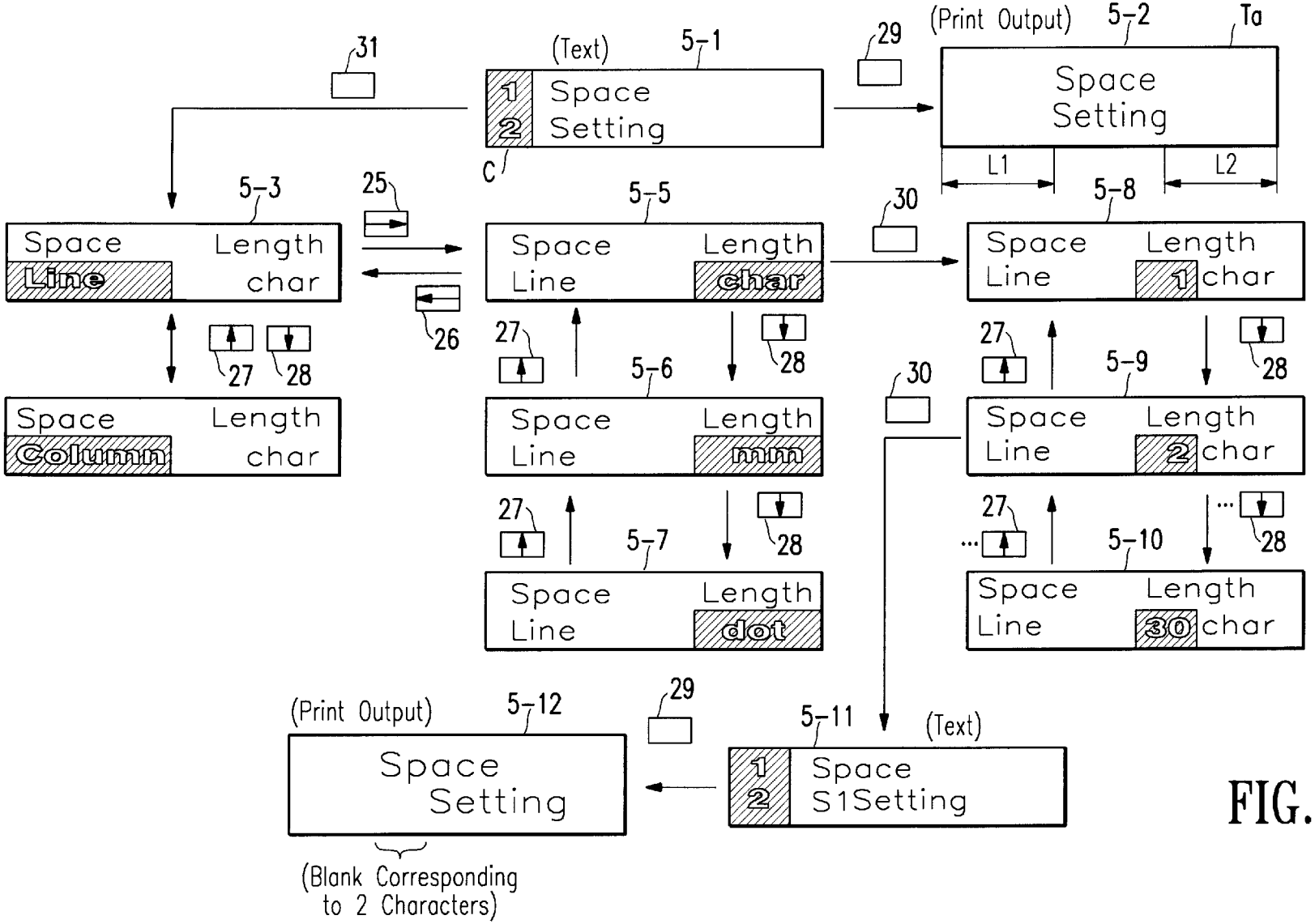
FIG. 5 is a diagram illustrating the blank setting operation.

FIG. 4 illustrates the blank input operation and FIG. 5 shows the condition of the display screen 9*a* which switches according to the setting in the blank input operation. FIG. 5-1 shows an example of text data input from the keyboard 2 and stored in the text memory 61. In this example, the text data consists of the word "Space" input on the first line, and the word "Setting" input on the second line. Two lines of text data are displayed on the display screen 9*a* of the liquid crystal display 9. As shown in FIG. 5-1, the cursor C (which constitutes the blank position designating means in this embodiment) is at the head position of the second line of the text data displayed on the display screen 9*a*.

When no blank is inserted into the input text data, the printing key 29 is operated and printing results as shown in FIG. 5-2 are obtained. That is, the printing of each line is started with a predetermined margin L1 provided at the forward end of the piece of tape Ta. The amount of tape feeding is set such that another predetermined margin L2 is left at the rear end of the piece of tape Ta after the printing. These printing and feeding operations are the same as those in a conventional control mechanism.

When setting a blank, that is, when inserting a blank in the text data, the cursor C is first moved to the insertion position (step ST 1 of FIG. 4) and, in this condition, the blank setting key 31 is depressed (step ST 2). Thus, control is shifted to the blank input mode and the display on the display screen 9*a* of the liquid crystal display 9 is changed to that of FIG. 5-3. In the blank input mode, the type of blank setting is designated first (step ST 3). Specifically, selection is made with the upward and downward cursor moving keys 27 and 28, which constitute part of the blank length designating means, to indicate whether the blank setting is to be executed according to line units, that is, only with respect to a specific line, or according to paragraph units, that is, with respect to every line. In the initial display of the display screen 9*a* as shown in FIG. 5-3, the cursor C is positioned at the display position "Line" for designating a setting in line units and the display of that portion is given in reverse video, indicating that the apparatus is in the condition for setting in line units. That is, in this embodiment, the upward and downward cursor moving keys 27 and 28, which are operated in step ST 3, constitute the type of blank setting means.

Regarding the cursor C in the blank input mode, it is to be noted that no such underline-type cursor as that given during the input of text data is indicated. Thus, in the blank input mode, the cursor C means the display in reverse video itself.

In this condition, when the downward cursor moving key 28 is depressed, the "Line" display portion is switched to a "Column" display indicating a blank setting in paragraph units. The display screen 9*a* is changed to the state as shown in FIG. 5-4 to indicate that the apparatus is set for paragraph units. When the upward cursor moving key 27 is depressed, the display screen 9*a* is changed back to the state as shown in FIG. 5-3, indicating the apparatus is set for line units.

When the type of blank setting has been designated, the unit length of the blank is also designated (step ST 4). For example, when the cursor moving key 25 is depressed as shown in FIG. 5-3, the display screen 9*a* changes to the state as shown in FIG. 5-5. The cursor C moves to the position "char" indicating the blank length setting is operating in a "character" units mode.

Figures 6, 6A, 6B:
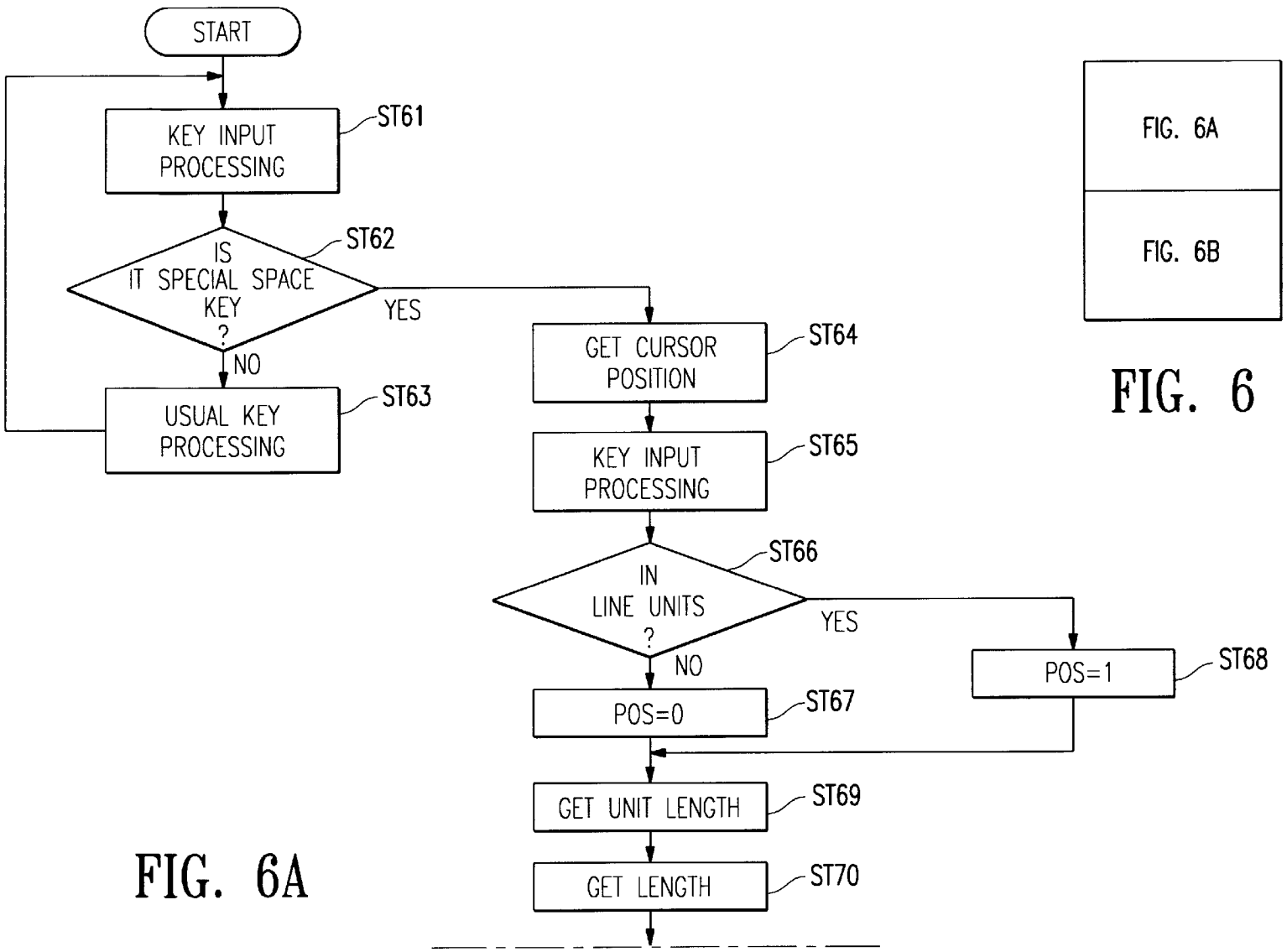
FIGS. 6, 6A and 6B is a flowchart illustrating a blank setting input operation.
Figure 6B:
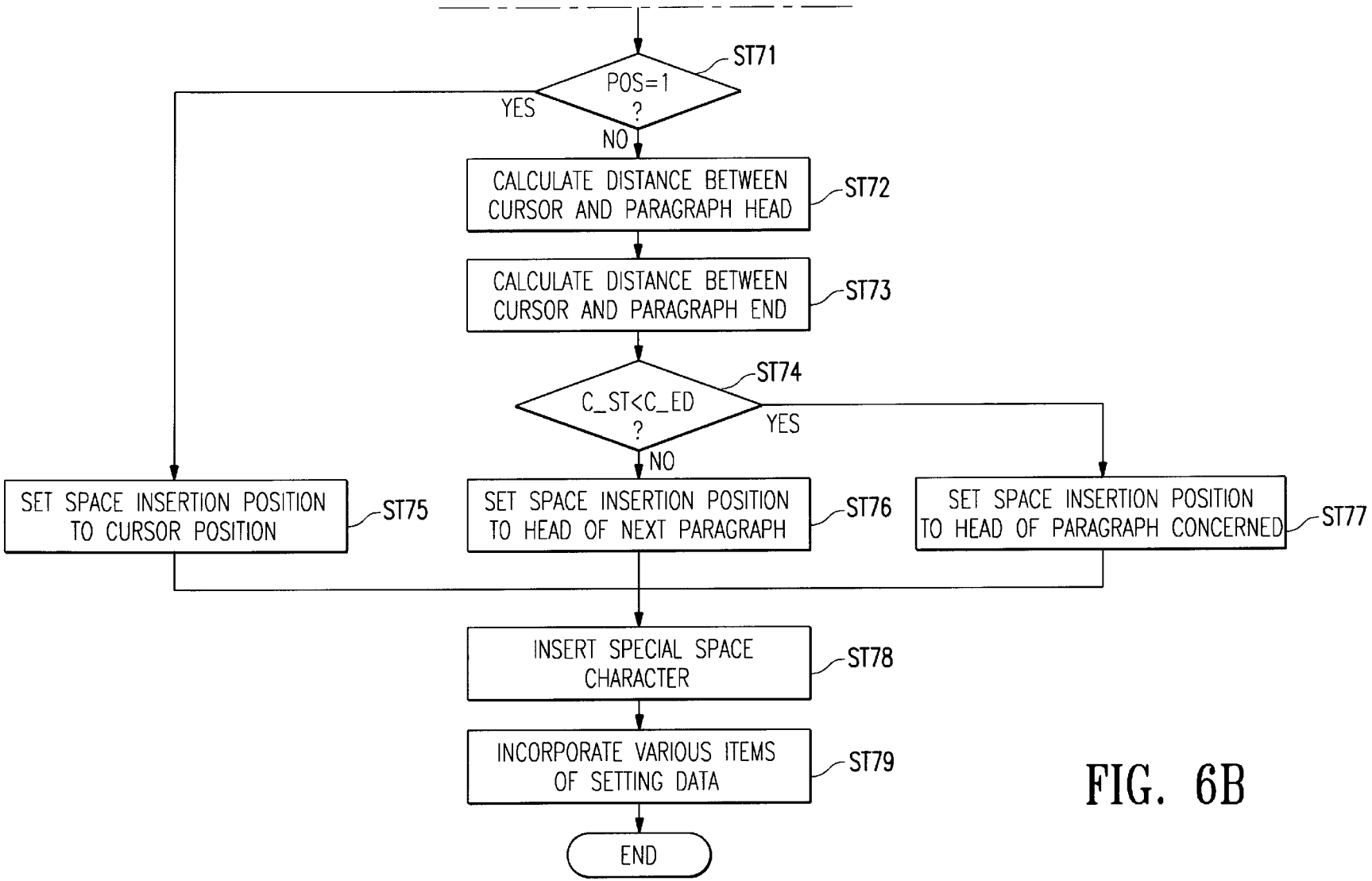
Figure 7:
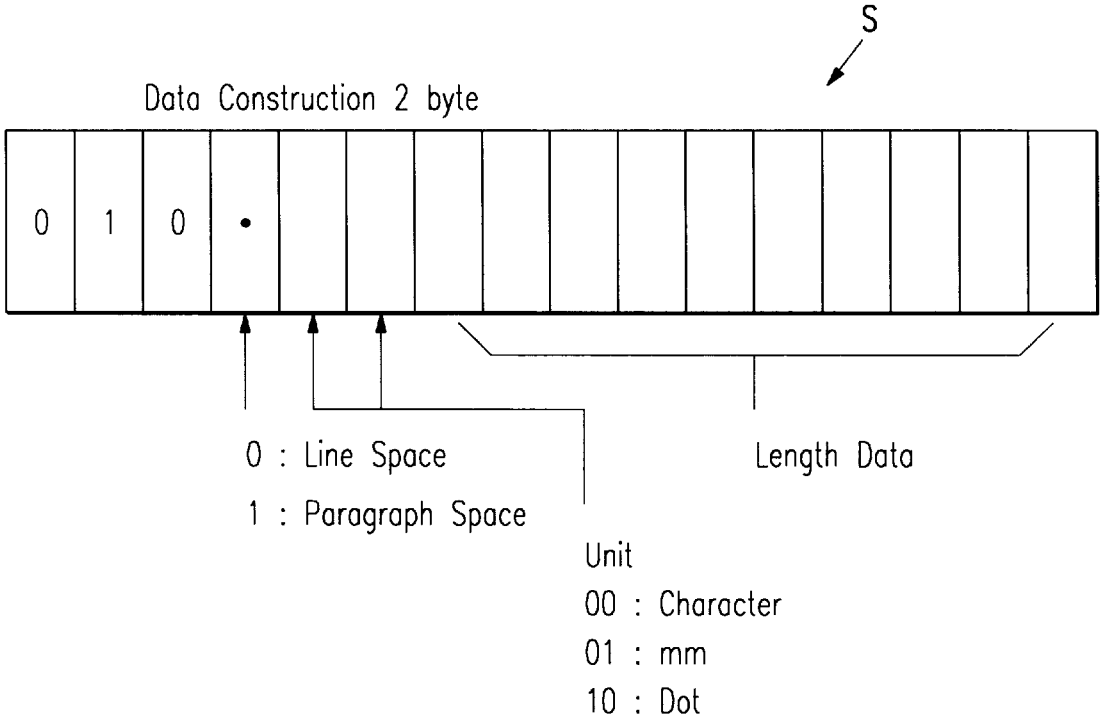
FIGS. 7 is a diagram showing the construction of blank character data.

When the cursor moving key 28 is operated, the display screen 9*a* switches to the "mm" state shown in FIG. 5-6 and then to the "dot" state shown in FIG. 5-7. When the cursor moving key 27 is operated, the switching is reversely effected. The "mm" state indicates the blank length setting to be operating in a millimeters units mode. The "dot" state indicates the blank length setting to be operating in a printing dots units mode. It should be noted that in addition to the above examples, it is also possible to adopt "inches", "centimeters", "points", etc. as the unit length for the blank.

Next, the length of the blank is designated on the basis of the pre-set unit Length as mentioned above (step ST 5). For example, when the blank length setting is to be operated in a character units mode, the selection key 30 is depressed as shown in FIG. 5- 5. The display screen 9*a* then changes to that shown in FIG. 5-8, which is a display in which the blank length corresponds to one character.

In this condition, a blank corresponding to, for example, up to 30 characters can be designated by depressing the cursor moving keys 27 and 28. FIG. 5-9 shows a condition in which a blank corresponding to 2 characters is designated and FIG. 5-10 shows a condition in which a blank corresponding to 30 characters is designated. Thus, in this embodiment the right-hand, upward and downward cursor moving keys 25, 27, 28 and the selection key 30, which are operated in steps ST 4 and ST 5 of FIG. 4, constitute the blank length designating means.

Finally, the selection key 30 is depressed, whereby the type of blank setting, the unit length and the blank length which have been set as above are fixed (step ST 6). This causes the generation of blank characters S having the blank information as set. These blank characters S are inserted at a designated position of the text data in the text memory 61. In the described example, blank characters S providing a blank corresponding to two characters at the head of the second line are inserted. FIG. 5-11 shows the display on the display screen 9*a* corresponding to this condition. The "s1" in the "s1Setting" of the second line is a special character to indicate the insertion of the blank characters S at this position and distinguishes the code from the character "S" of the alphabet.

FIG. 7 shows an example of the data construction of the blank character S. As shown in the figure, the blank character S has a 2-byte construction, the first three bits of which indicate that it is a blank character. The next one bit indicates whether the type of blank setting is line units or paragraph units, and the subsequent two bits indicates whether the unit length of the blank is in characters, millimeters or dots. The remaining bit group indicate the length of the blank.

The output result of the text data set as described above is as shown in FIG. 5-12. The print output includes a blank at a position corresponding to the first two characters of the second line of the text data.

FIG. 6 is a detailed flowchart showing the procedures in the above-described blank input mode. As shown in the drawing, the key input processing is first executed (step ST 61) with the power source on. A judgment is then made as to whether the input key is a special space key such as the blank setting key 31 (step ST 62). When the input is from a key other than the blank setting key 31, e.g., the character key 21, the usual key input accepting process is executed (step ST 63).

When the blank setting key 31 is depressed, the procedure advances from step ST 62 to step ST 64, where blank input control is started. In the blank input control, the position of the cursor C designated in step ST 1 of FIG. 4 is received (step ST 64). The key input processes executed in steps ST 3 through ST 5 of FIG. 4 are then conducted (step ST 65). Next, a judgment is made as to whether the type of blank setting is designated as line units or not (step ST 66). In the case of line unit designation, a line designation flag POS is set to "1" (Step ST 68). When the type of blank setting is not designated as line unit, i.e., in the case of paragraph unit designation, resetting to "0" is effected (step ST 67). The blank unit length acquiring operation and the length acquiring operation are then conducted (steps ST 69, ST 70).

Next, a judgment is made as to whether the line designation flag POS is "1" or not (step ST 71). When the result of the judgment is in the affirmative ("1"), that is, when the designation is in line units, the blank insertion position is set to the position of the cursor C (step ST 75). When the result of the judgment is in the negative ("0"), that is, when the designation is in paragraph units, the distance between the position of the cursor C and the head of the paragraph (including the cursor C), C_ST, and the distance between the position of the cursor C and the end of the paragraph, C_ET, are calculated (steps ST 72 and ST 73). The distances C_ST and C_ET are then compared (step ST 74). When C_ST is less than (<) C_ET, the blank insertion position is set to the head of the paragraph concerned (step ST 77). When C_ST is greater than or equal to (≧) C_ET, the blank insertion position is set to the head of the next paragraph (step ST 76). Accordingly, when the designation of the blank setting is made in paragraph units, the blank insertion position is set to the head of the paragraph concerned when the position of the cursor C is nearer to the head of the paragraph concerned. When the position of the cursor C is nearer to the end of the paragraph concerned, the blank insertion position is set to the head of the next paragraph when the position of the cursor C is nearer to the end of the paragraph concerned.

Next, the blank character S including blank information composed of the type of blank setting, the unit length and the blank length is inserted at the position of the text data of the text memory 61 set in the above step ST 75, ST 76 or ST 77 (step ST 78). Finally, various items of setting data are incorporated (step ST 79) to thereby terminate the control program.

Figures 8, 8A:
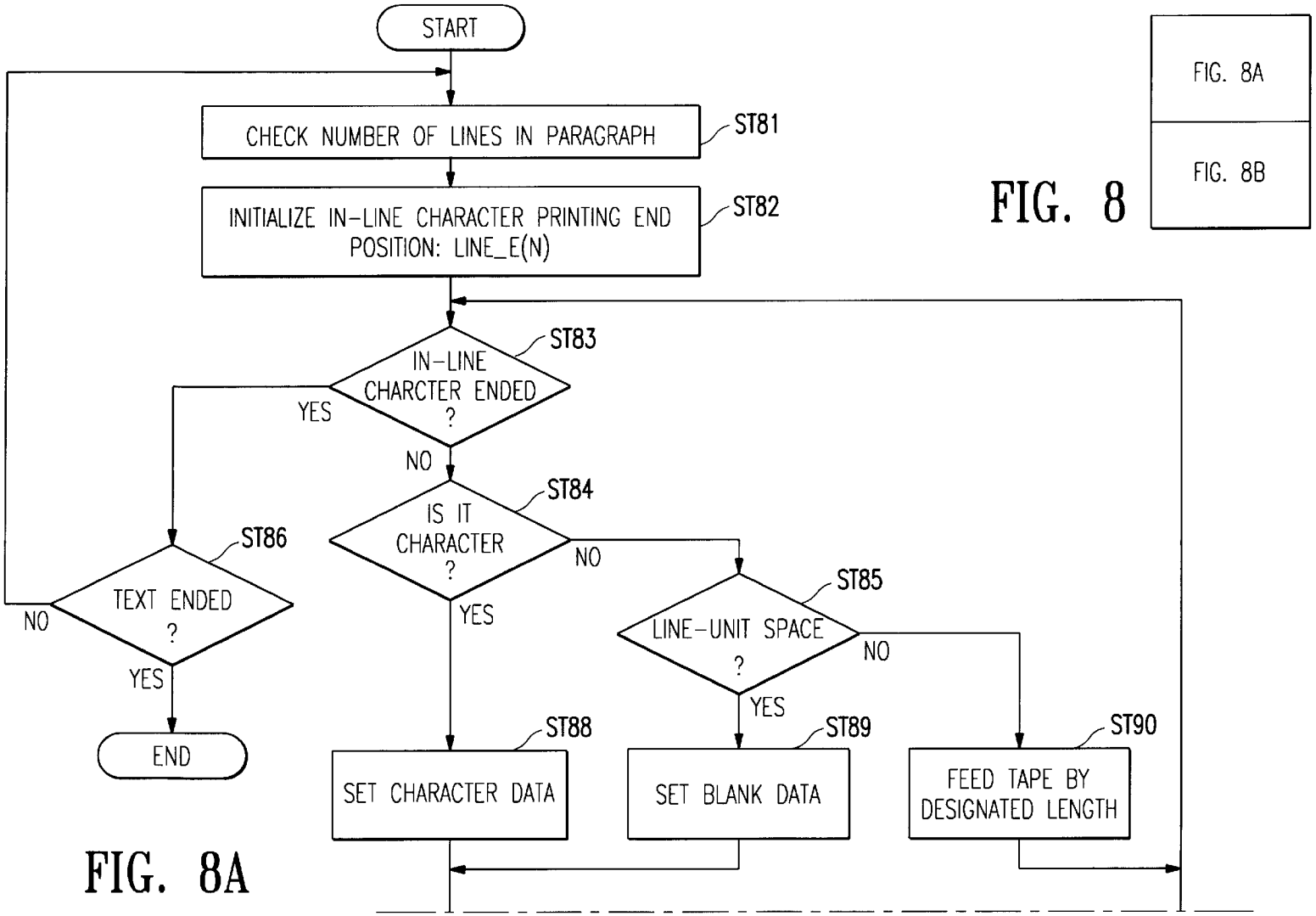
FIGS. 8, 8A and 8B is a flowchart illustrating a printing operation.
Figure 8B:
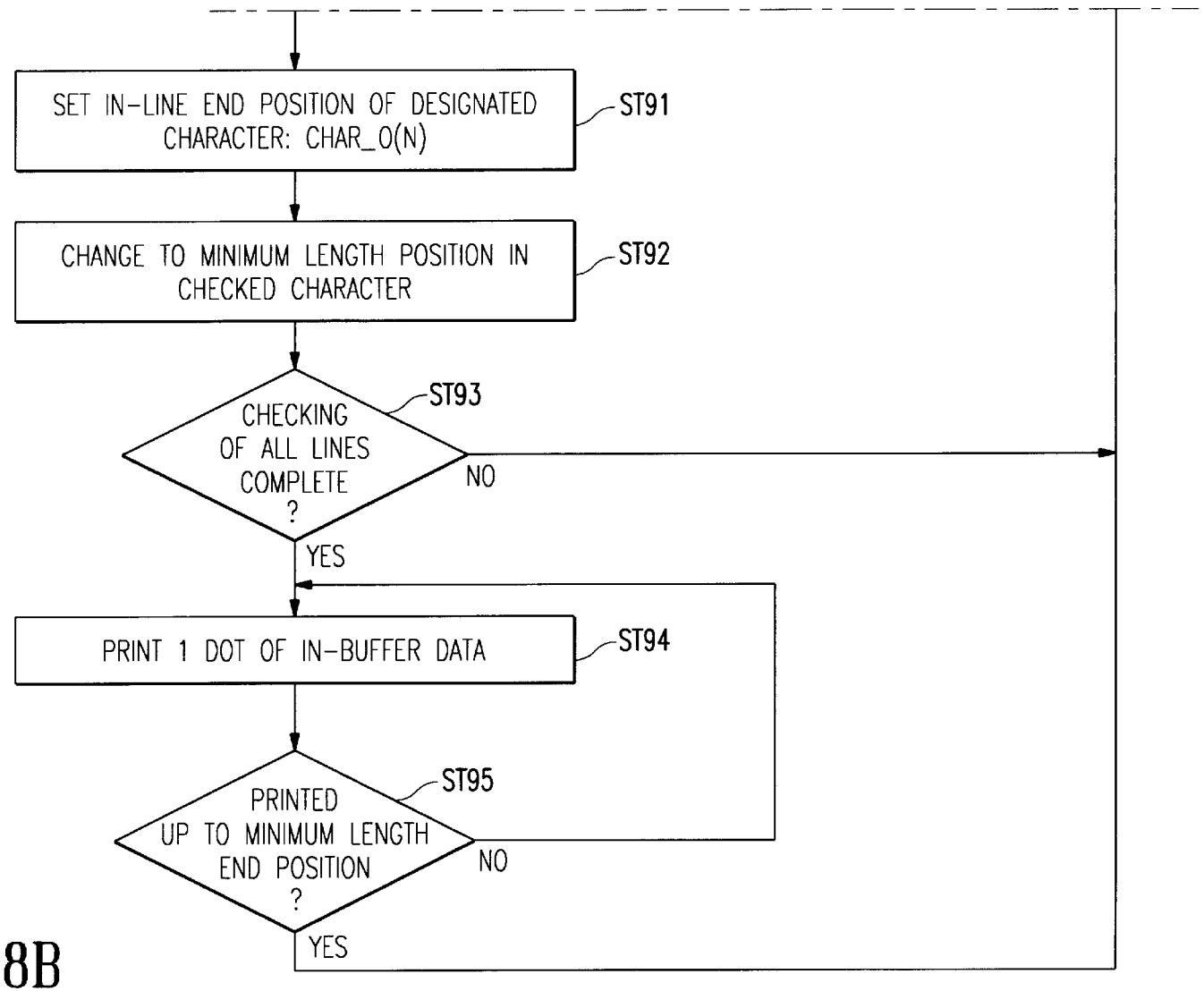

In FIG. 8, a flowchart schematically illustrates the control operation for printing text data to which the blank character S has been inserted as described above. The text data of the text memory 61 is sequentially read in and a judgment is made as to whether the text data being read in is a character or not (step ST 84). When the text data is a character, character data based thereon is set (step ST 88). If the result of step ST 84 is negative, that is, if the text data is a blank character S, a judgment is made as to whether the blank setting is designated as line units or not (step ST 85). In the case of line unit designation, blank data is set on the basis of the blank character S (step ST 89). After this, the above operation is repeated and when all the text data has been set (step ST 93), printing is performed in accordance with the above text data (steps ST 94 and ST 95). Thus, printing is performed while providing a blank of a designated length at a designated position in the text data as shown in FIG. 5-12.

If the result of the above-described step ST 85 is negative, that is, in the case of paragraph unit designation, tape feeding is executed by the length of the blank designated in the blank character S (step ST 90). It is therefore possible to form a paragraph with a blank of a designated length provided in every line.

In this embodiment, a position in text data where a blank is to be set is designated with the cursor C and the blank setting key 31 is depressed to designate the type of blank setting, the unit length and the length of the blank. It is therefore easy to provide the blank thus designated. While the above description has been given with reference to the case in which a blank is set at the head of the line concerned, it is also possible to provide a blank of a desired length at a position between both ends of the line concerned. Thus, it is possible to easily provide a blank of a desired length at a desired position in text data thereby greatly enhancing the degree of freedom available in controlling printing layout.

Figure 9:
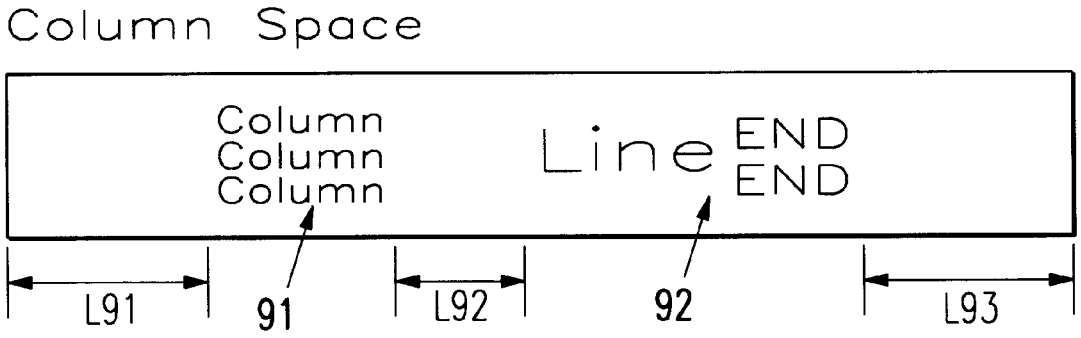
FIG. 9 is a diagram showing a print output example in which a blank is set at the head of a paragraph.

Further, while in the above description the blank setting in paragraph units is effected at the head of each paragraph, it is naturally also possible to execute control processing such that a blank is inserted at the end of each paragraph. For example, FIG. 9 shows a case in which printing output is effected with a blank setting in paragraph units. As shown in the drawing, a blank L91 is set at the head of the first paragraph 91 and a blank L92 is set at the head of the second paragraph 92. That is, the space between the first and second paragraphs 91 and 92 is set as the blank L92. Another blank L93 is set at the rear end of the paragraph 92. In this way, when it is desirable to set a blank at the rear end of a paragraph, the margins at the front and rear ends of the piece of tape (obtained by cutting after printing) can be set to a desired length.

As described above, in the tape printing apparatus 1, a blank character S is generated and inserted at a designated position in text data. Thus, it is possible to perform printing while providing a blank having a designated length. In addition, in the tape printing apparatus 1, a special blank character can be generated.

Figure 10:
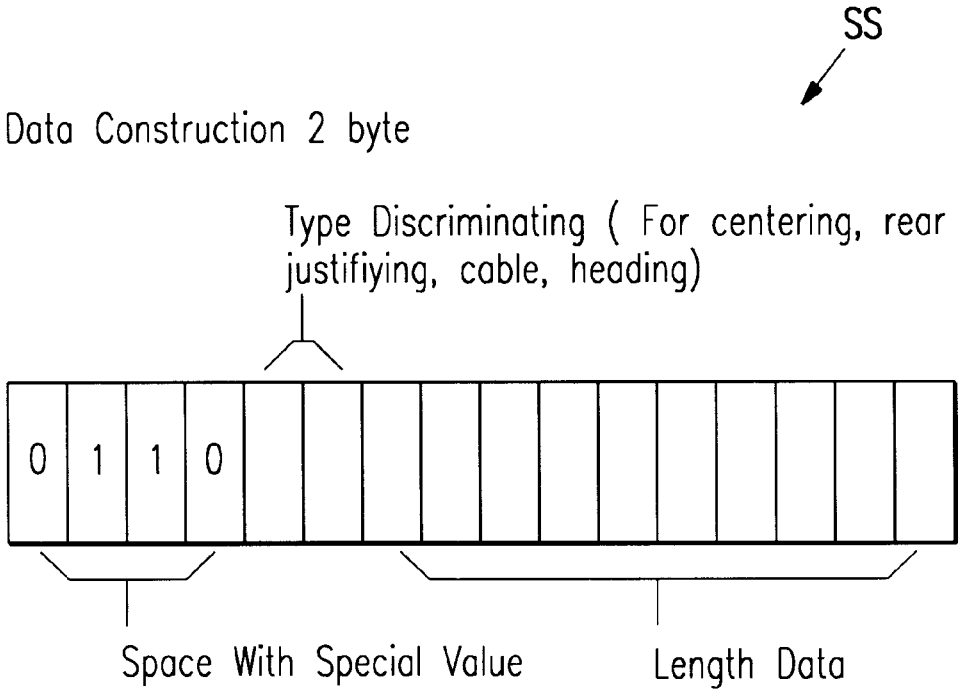
FIG. 10 is a diagram showing the construction of special blank character data.

FIG. 10 shows an example of the data construction of a special blank character SS which is of a 2-byte construction. The first four bits constitute a portion indicating that it is a special blank character. The next two bits constitute a portion indicating the kind of special blank character. In this embodiment, there are provided special blank characters for centering, rear justification, cable winding, heading, and others as desired. The remaining group of bits constitute a portion for retaining the length data of the blank. However, as described below, when a special blank character is inserted, the blank length is determined through calculation so that some other working area can be utilized for this portion.

The input operation for this special blank character is basically the same as that for the blank character S described above. By operating the special blank setting key 32, the apparatus enters into a mode for inputting a special blank character SS. The special blank character SS differs from the blank character S in that the insertion position is at the head of a line or of a paragraph and that the blank length is calculated in accordance with a previously set calculation program rather than being designated by the user. Thus, the special blank character SS is input by using the special blank setting key 32 which is provided as a key separate from the blank setting key 31 used for setting the blank character S.

Figure 11A:
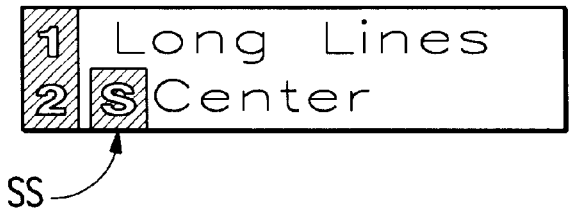
FIGS. 11A and 11B is a diagram illustrating a centering printing operation.
Figure 11B:
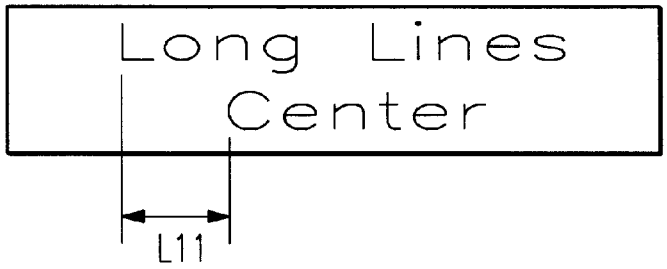

First, when the special blank character SS for centering is inserted, the length of the line concerned is subtracted from the length of the longest line in the paragraph in which the blank character is inserted. The subtraction result is divided in half and the length thus obtained is processed so as to be arranged at the head of the line concerned when it is printed. For example, when, as shown in FIG. 11(*a*), the special blank character SS is inserted at the head of the second line of the text, a blank L11 is formed, as shown in FIG. 11(*b*), at the head of the second line such that the line concerned is positioned at the center on the basis of the first line, which is the longest line of the paragraph including the line concerned.

Figure 12A:
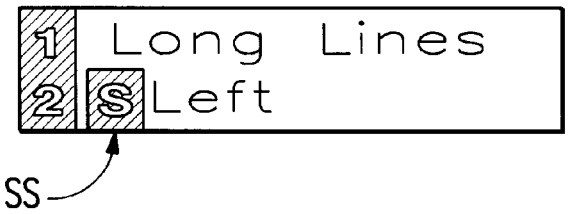
FIGS. 12A and 12B is a diagram illustrating a rear justification printing operation.
Figure 12B:
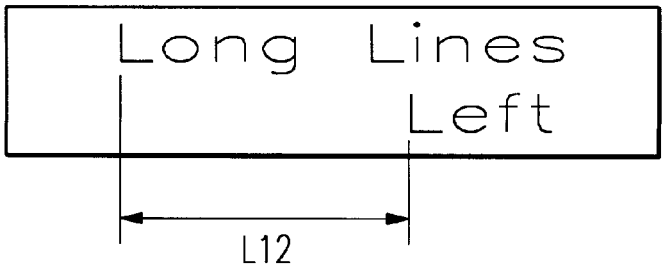

Next, when the special blank character SS for rear justification is inserted, the length of the line concerned is subtracted from the length of the longest line of the paragraph including the line in which the special blank character is inserted. A blank having a length corresponding to the subtraction result is arranged at the head of the line concerned when it is printed. For example, when, as shown in FIG. 12(*a*), the special blank character SS is inserted at the head of the second line of the text, a blank L12 is formed, as shown in FIG. 12(*b*), at the head of the second line such that the positions of the line ends are aligned with respect to each other on the basis of the first line, which is the longest line of the paragraph including the line concerned.

Figure 13A:
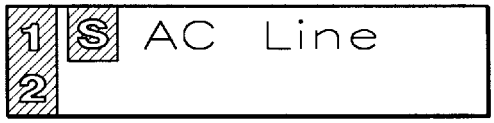
FIGS. 13A, 13B, and 13C is a diagram illustrating a printing operation for cable winding.
Figure 13B:
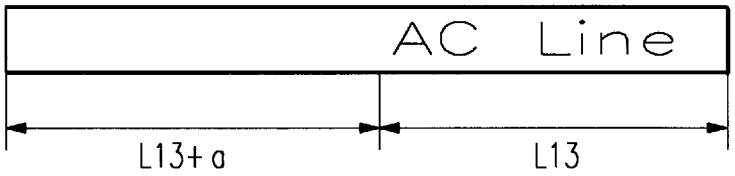
Figure 13C:
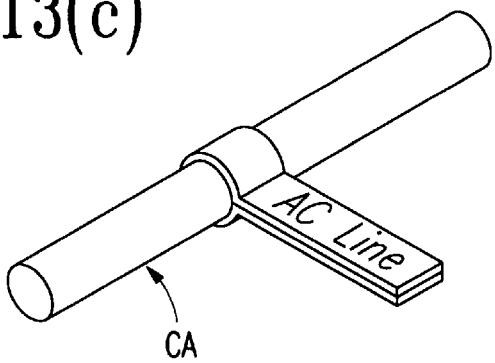

When the special blank character SS for cable winding is inserted, tape feeding is performed at the head or rear of the text by a length obtained by adding a predetermined length to the length of the total text. For example, when, as shown in FIG. 13(*a*), the special blank character SS is inserted at the head of a text consisting of a single line, a long margin having a length obtained by adding a predetermined length a to the total length L13 of the text is, formed, for example, at the head of the line concerned, that is, at the head of the text, as shown in FIG. 13(*b*). Thus, when, as shown in FIG. 13(*c*), the piece of tape obtained is wound around a cable CA or the like, the printed side is located on the visible side and is not on the portion of the piece wound around the cable. Thus, it is easy to view the printed portion.

Figure 14:
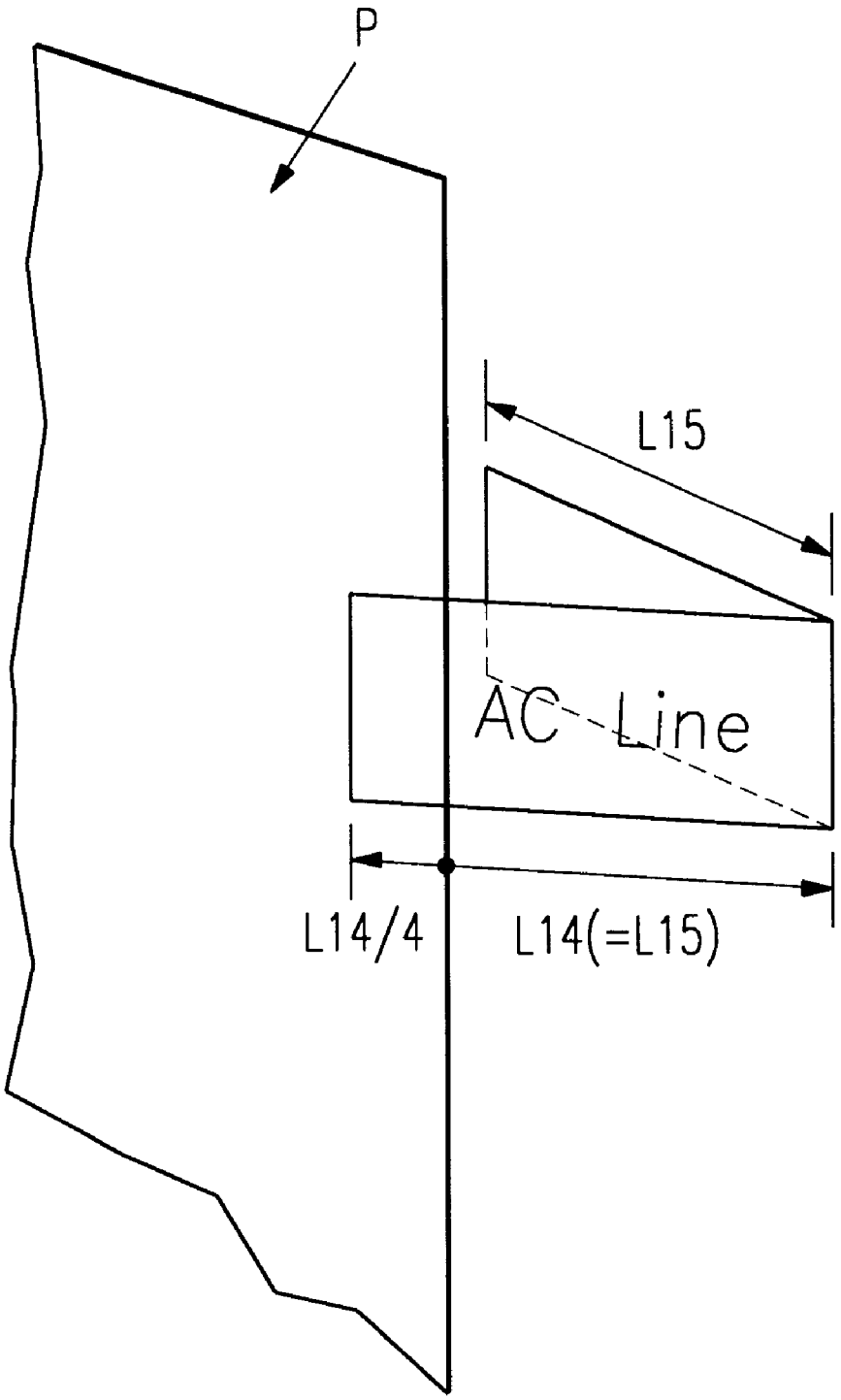
FIG. 14 is a diagram illustrating a heading printing operation.

Next, when the special blank character SS for heading is inserted, a margin having a length corresponding, for example, to a quarter of the total length of the text is formed at the head of the text. Tape feeding and printing are then conducted such that a margin, having the same length as the text is formed at the end of the text. FIG. 14 shows a piece of tape obtained in this manner. The margin L14/4 at the head of the text is utilized as the portion to be attached to a document P or the like, and the margin L15, whose length is the same as the total length L14 of the text, is attached to the back side of the document to cover the adhesion portion.

In this way, the tape printing apparatus 1 allows a special blank character SS to be input and the length of the blank or margin to be calculated in accordance with the kind of special blank character and the total length of the text. Further, in accordance with the calculation results, a blank or margin can be automatically formed before and after a line, paragraph or text. Thus, there is no need to designate the length of the blank or margin in this case, thereby enabling them to be set with ease.

It should be noted that the present invention is not restricted to the embodiments described above but allows various modifications without departing from the scope of invention. For example, instead of using the keyboard 2, it is possible to input a text formed by a personal computer or the like through a cable or equivalent. Further, apart from the designation of the type of blank setting as units of lines or paragraphs as shown in the embodiments, designation in other units is possible. For example, when the same phrase is repeated, the designation can be effected using this repeated phrase as the unit.

As described above, in the tape printing apparatus with a blank setting function of the present invention, it is possible to easily make a blank with a desired length at a desired position when printing input text data, thereby achieving an improvement in the degree of freedom in controlling print layout. Further, it is possible to easily and appropriately provide margins of predetermined lengths at the head and rear of text data, thereby achieving a further improvement in the degree of freedom in controlling print layout.

What is claimed is:

1. A tape printing apparatus with a blank setting function, comprising:

printing means for printing text data on a tape-like recording medium in a longitudinal direction of the tape-like recording medium to be wound around a cable;

blank setting means for designating a blank to be formed in the tape-like recording medium in the longitudinal direction thereof adjacent to a head of the text data, the blank having a sum of a length of the text data and a length of a portion of the tape-like recording medium that is wound around the cable; and control means for controlling the printing means such that text data is printed on the tape-like recording medium while leaving the blank designated by the blank setting means.

2. A tape printing apparatus according to claim 1, further comprising means for cutting the tape-like printing medium into a tape segment with the text data printed thereon adjacent a rear of the text data when the printing means prints the text data on the tape-like printing medium.

3. A tape-like printing medium to be used in the tape printing apparatus according to claim 1, wherein the tape-like printing medium is cut into a tape segment with the text data printed thereon adjacent a rear of the text data when the printing means prints the text data on the tape-like printing medium.

4. A tape printing apparatus according to claim 1, wherein the blank setting means designates a rear margin adjacent to an end of the text data, the rear margin having a length shorter than that of the blank formed adjacent to the head of the text data.

5. A tape printing apparatus according to claim 1, wherein the printing means prints the text data on the tape-like recording medium such that the text data extends in a direction in which the tape-like recording medium is wound.

6. A tape printing apparatus according to claim 1, wherein a length of the tape-like recording medium to be printed is changeable in accordance with diameters of the cables to be wound around.

7. A tape printing apparatus according to claim 1, wherein the tape-like recording medium has an adhesive portion at a back surface thereof on which the text data is not printed.

8. A tape printing apparatus according to claim 1, wherein the tape-like recording medium has a front surface on which the text data is printed and a rear surface having an adhesive portion in at least one area of the rear surface to be adhered to another area of the rear surface of the tape-like recording medium.

9. A tape printing apparatus according to claim 1, wherein a length of a character string to be printed on the recording medium is changeable.

10. A method of printing text data on a tape-like printing medium in a longitudinal direction of the tape-like recording medium to be wound around a cable, the method comprising:

designating a blank to be formed in the tape-like recording medium in the longitudinal direction thereof adjacent to a head of the text data, the blank having a sum of a length of the text data and a length of a portion of the tape-like recording medium that is wound around the cable; and printing text data on the tape-like recording medium while leaving the blank on the tape-like recording medium.

11. A method according to claim 10, wherein the step of designating a blank designates a rear margin adjacent to an end of the text data, the rear margin having a length shorter than that of the blank formed adjacent to the head of the text data.

12. A method according to claim 10, wherein the step of printing text data on the tape-like recording medium prints the text data on the tape-like recording medium such that the text data extends in a direction in which the tape-like recording medium is wound.

13. A tape printing apparatus with a blank setting function, comprising:

printing means for printing text data on a tape-like recording medium to be attached to a sheet-like medium;

blank setting means for designating a first blank to be formed in the tape-like printing medium adjacent to a head of the text data, the first blank having a length corresponding to an adhesion portion of the tape-like recording medium to be attached to the sheet-like medium and a second blank to be formed in the tape-like printing medium adjacent to a rear of the text data, the second blank having a length corresponding to the text data; and control means for controlling the printing means such that text data is printed on the tape-like recording medium while leaving the first blank and the second blank designated by the blank setting means.

14. A tape printing apparatus according to claim 13, wherein the tape-like printing medium is cut into a tape segment with the text data printed thereon adjacent to a rear of the second blank when the printing means prints the text data on the tape-like printing medium.

15. Ay tape-like printing medium to be used in the tape printing apparatus according to claim 13, wherein the tape-like printing medium is cut into a tape segment with the text data printed thereon adjacent a rear of the text data when the printing means prints the text data on the tape-like printing medium.

16. A tape printing apparatus according to claim 13, wherein a length of a character string to be printed on the recording medium is changeable.

17. A method of printing text data on a tape-like printing medium, the method comprising:

printing text data on a tape-like recording medium to be attached to a sheet-like medium;

designating a first blank to be formed in the tape-like printing medium adjacent to a head of the text data, the first blank having a length corresponding to an adhesion portion of the tape-like recording medium to be attached to the sheet-like medium and a second blank to be formed in the tape-like printing medium adjacent to a rear of the text data, the second blank having a length corresponding to the text data; and printing text data on the tape-like recording medium while providing the designated first blank and the second blank with the tape-like recording medium.

18. A method of printing text data on a tape-like printing medium, the method comprising:

a blank data selection step for selecting one of a plurality of predetermined blank data sets representative of different blank lengths;

a blank data insertion step for inserting the selected one of the plurality of predetermined blank data sets in the text data at a designated location; and a printing step for printing the text data with the selected one of the plurality of predetermined blank data sets inserted at the designated location on the tape-like printing medium.

* * * * *